US010280567B2

(12) United States Patent
Vogt et al.

(10) Patent No.: US 10,280,567 B2
(45) Date of Patent: May 7, 2019

(54) TEXTURE SUBTRACTIVE PATTERNING

(71) Applicant: Kimberly-Clark Worldwide, Inc., Neenah, WI (US)

(72) Inventors: Kevin Joseph Vogt, Neenah, WI (US); Peter John Allen, Neenah, WI (US); Jeffrey Dean Holz, Sherwood, WI (US); Tara Marie Logut, Coraopolis, PA (US); Robert Eugene Krautkramer, Combined Locks, WI (US); Samuel August Nelson, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/745,486

(22) PCT Filed: Apr. 21, 2017

(86) PCT No.: PCT/US2017/028724
§ 371 (c)(1),
(2) Date: Jan. 17, 2018

(87) PCT Pub. No.: WO2017/196517
PCT Pub. Date: Nov. 16, 2017

(65) Prior Publication Data

US 2018/0216298 A1 Aug. 2, 2018

Related U.S. Application Data

(60) Provisional application No. 62/333,598, filed on May 9, 2016.

(51) Int. Cl.
*B31F 1/07* (2006.01)
*D21H 27/02* (2006.01)
(Continued)

(52) U.S. Cl.
CPC ..... *D21H 27/02* (2013.01); *A47K 10/16* (2013.01); *B31F 1/07* (2013.01); *B31F 1/36* (2013.01);
(Continued)

(58) Field of Classification Search
CPC ... A47K 10/16; B31F 1/07; B31F 1/36; D21F 11/006; D21F 11/14; D21F 23/56; D21F 27/40; D21H 27/02
See application file for complete search history.

(56) References Cited

U.S. PATENT DOCUMENTS 3,176,058 A 3/1965 Emanuel
3,337,388 A 8/1967 Wosaba, II
(Continued)

FOREIGN PATENT DOCUMENTS

CN 102555304 A 7/2012
EP 0 864 014 B1 1/2002
(Continued)

OTHER PUBLICATIONS

Co-pending U.S. Appl. No. 15/745,493, filed Jan. 17, 2018, by Vogt et al. for "Topically Treated Patterned Tissue Product."

*Primary Examiner* — Joseph S Del Sole
*Assistant Examiner* — John Robitaille
(74) *Attorney, Agent, or Firm* — Kimberly-Clark Worldwide, Inc.

(57) ABSTRACT

The present application provides a method of manufacturing a patterned tissue product comprising a textured background surface, and a design element wherein the design element is formed by removing a portion of the textured background. The method comprises the steps of (a) providing a tissue web having a textured top surface lying in a surface plane and a bottom surface lying in a bottom plane wherein there
(Continued)

is a z-directional height difference between the surface plane and the bottom plane; (b) conveying the web through a first nip created by a first receiving roll and a pattern roll having a plurality of protuberances forming a design pattern; (c) conforming a portion of the web to the protuberances; and (d) conveying the web into a second nip formed between the pattern roll and a second receiving roll to form a patterned tissue product having a design element corresponding to the plurality of protuberances, the design element lying in a design element plane that is between the surface plane and the bottom plane. The textured surface provides the tissue with an overall background pattern that is typically visually distinct from the design element imparted thereon. The method may further comprise the step of applying a papermaking additive or water to the conformed portion of the web via an applicator roll between step (c) and (d). The pattern roll is generally a hard and non-deformable roll, such as a steel roll. The first receiving roll has a hardness greater than 40 Shore (A), such as from 40 to 100 Shore (A). The second receiving roll may have a smooth or non-smooth surface, and the pressure applied at the second nip is greater than 30 pli, such as from about 50-250 pli.

11 Claims, 6 Drawing Sheets

(51) Int. Cl.

| | |
|---|---|
| ***A47K 10/16*** | (2006.01) |
| ***B31F 1/36*** | (2006.01) |
| ***D21H 27/40*** | (2006.01) |
| ***D21H 23/56*** | (2006.01) |
| ***D21F 11/00*** | (2006.01) |
| ***D21F 11/14*** | (2006.01) |

(52) U.S. Cl.
CPC ..... *D21F 11/006* (2013.01); *D21F 11/14* (2013.01); *D21H 23/56* (2013.01); *D21H 27/40* (2013.01)

(56) References Cited

U.S. PATENT DOCUMENTS

| | | | |
|---|---|---|---|
| 3,692,622 | A | 9/1972 | Dunning |
| 4,166,758 | A | 9/1979 | Fujita et al. |
| 4,191,609 | A | 3/1980 | Trokhan |
| 4,211,743 | A | 7/1980 | Kos et al. |
| 4,528,239 | A | 7/1985 | Trokhan |
| 4,536,431 | A | 8/1985 | Wyckoff |
| 5,024,799 | A | 6/1991 | Harp et al. |
| 5,549,790 | A | 8/1996 | Van Phan |
| 5,840,403 | A | 11/1998 | Trokhan et al. |
| 5,871,607 | A | 2/1999 | Hamilton |
| 6,030,690 | A | 2/2000 | McNeil et al. |
| 6,099,940 | A | 8/2000 | Hamilton et al. |
| 6,106,928 | A | 8/2000 | Laurent et al. |
| 6,113,740 | A | 9/2000 | Oriaran et al. |
| 6,117,525 | A | 9/2000 | Trokhan et al. |
| 6,277,226 | B1 | 8/2001 | Schulz |
| 6,277,467 | B1 | 8/2001 | Dwiggins et al. |
| 6,398,909 | B1 | 6/2002 | Klerelid |
| 6,420,013 | B1 | 7/2002 | Vinson et al. |
| 6,470,945 | B1 | 10/2002 | Biagiotti |
| 6,547,928 | B2 | 4/2003 | Bamholtz et al. |
| 6,701,637 | B2 | 3/2004 | Lindsay et al. |
| 7,351,308 | B2 | 4/2008 | Urlaub et al. |
| 7,396,593 | B2 | 7/2008 | Liu et al. |
| 7,470,345 | B2 | 12/2008 | Troxell et al. |
| 7,988,823 | B2 | 8/2011 | Burazin et al. |
| 8,260,592 | B2 | 9/2012 | Schmitt et al. |
| 8,455,077 | B2 | 6/2013 | Vinson et al. |
| 2003/0010228 | A1 | 1/2003 | Lofink |
| 2003/0026950 | A1 | 2/2003 | Kershaw et al. |
| 2003/0111169 | A1 | 6/2003 | Baggot et al. |
| 2004/0007338 | A1 | 1/2004 | Neveu et al. |
| 2004/0055721 | A1 | 3/2004 | Hilbig et al. |
| 2005/0098281 | A1 | 5/2005 | Schulz et al. |
| 2006/0137840 | A1 | 6/2006 | Burazin et al. |
| 2006/0278357 | A1 | 12/2006 | Suzuki et al. |
| 2006/0286885 | A1 | 12/2006 | Schuh et al. |
| 2007/0137808 | A1 | 6/2007 | Lostocco |
| 2008/0318004 | A1 | 12/2008 | Ruhe |
| 2009/0199986 | A1 | 8/2009 | Biagiotti |
| 2010/0233440 | A1 | 9/2010 | Tsai |
| 2010/0297286 | A1 | 11/2010 | Boatman et al. |
| 2010/0297402 | A1 | 11/2010 | Boatman et al. |
| 2010/0326613 | A1 | 12/2010 | Denis et al. |
| 2015/0225903 | A1 | 8/2015 | Jeannot et al. |

FOREIGN PATENT DOCUMENTS

| | | | |
|---|---|---|---|
| JP | 11-323787 | A | 11/1999 |
| WO | WO 2011/080941 | A1 | 7/2011 |
| WO | WO 2014/181389 | A1 | 11/2014 |

TEXTURE SUBTRACTIVE PATTERNING

BACKGROUND

In the manufacture of paper products, particularly tissue products, it is generally desirable to provide an aesthetically pleasing final product with as much bulk as possible without compromising other product attributes, including softness, flexibility, absorbency, hand feel, and durability. However, most papermaking machines operating today utilize a process known as "wet-pressing". In "wet-pressing" a large amount of water is removed from the newly-formed web of paper by mechanically pressing water out of the web in a pressure nip. A disadvantage of the pressing step is that it densifies the web, thereby decreasing the bulk and absorbency of the sheet. One problem encountered in the past by first wet web pressing and/or then dry embossing is the difficulty in obtaining a tissue basesheet with good functionality, such as absorbency and softness, in combination with a pleasant appearance. This wet-pressing step, while an effective dewatering means, compresses the web and causes a marked reduction in web thickness, thus reducing bulk. In addition, using embossing to apply signature designs to a dry web generally results in a paper product that is gritty to hand feel, stiffer at the pattern edges, and with decreased absorbency.

Alternatives to wet-pressing such as through-air drying generally subject the web to less compression during manufacturing. For example, through-air drying typically involves forming a wet web from papermaking furnish on a forming media, such as a forming fabric or wire. Then, the wet web is transferred to a permeable through-air-drying fabric around an open drum and non-compressively dried by passing hot air through the web while in intimate contact with the fabric. Throughdrying is a preferred method of drying a web because it avoids the compressive force of the dewatering step used in the conventional wet press method of tissue making. The resulting web optionally may be transferred to a Yankee dryer for creping. Such processes are typically referred to as creped through-air dried (CTAD). Because the web is substantially dry when transferred to the Yankee dryer, the process does not densify the sheet as much as the wet press process, however, embossing may still be needed to provide a tissue product having consumer preferred sheet bulk and designs. As with wet pressed webs, embossing has the drawback of a product that is gritty to hand feel, stiffer at the pattern edges, and with decreased absorbency.

An alternative to CTAD is the uncreped through-air dried (UCTAD) process described in U.S. Pat. Nos. 5,591,309 and 5,593,545. By eliminating the creping step the resulting web has relatively high bulk, good compressibility, and high resiliency, with the attendant benefits of increased absorbency and improved fiber utilization. While the webs improved bulk and resiliency may be desirable traits from a consumer perspective, they make the web difficult to emboss. Often patterns imparted to an UCTAD web by conventional embossing are poorly defined and fade over time as the bulk and resilient web relaxes.

Because it is poorly suited to embossing, tissue makers wishing to create UCTAD webs with design motifs have often resorted to using patterned through-air drying fabrics. For example, U.S. Pat. Nos. 6,749,719 and 7,624,765 disclose fabrics useful in the formation of tissue webs having design elements using the UCTAD process. While these fabrics may provide webs having design elements, they also impart the web with an overall textured background pattern.

Thus, it may be difficult to discern the design elements. Further, the addition of design elements to the through-air drying fabrics reduces their air permeability, which in-turn reduces manufacturing efficiency.

Accordingly, there remains a need in the art for imparting textured webs with a design element and more specifically a need for imparting designs on through-air dried webs without negatively affecting the web's physical properties or the efficiency with which the webs are manufactured.

SUMMARY

It has now been surprisingly discovered that a textured fibrous structure may be provided with a design element without resorting to traditional embossing. For example, in certain embodiments, the present invention provides a process for imparting a design element on a fibrous structure after formation of the textured web by passing the textured web through a nip to compress a portion of the web and subtract a portion of the textured structure. Subtraction of a portion of the web's texture results in a portion of the web being densified and assuming a design. The design is typically in the form of a design element that has an upper surface defining a design element plane that generally lies between the web's upper surface plane and bottom surface plane.

Accordingly, in one embodiment the present invention provides a method of manufacturing a patterned tissue product comprising the steps of providing a textured tissue web; conveying the web through a first nip created by a first receiving roll and a pattern roll having a plurality of protuberance corresponding to a design element; conforming a portion of the web to the protuberances; and conveying the web into a second nip formed between the pattern roll and a second receiving roll.

In other embodiments the present invention provides a method of manufacturing a patterned tissue product comprising the steps of providing a tissue web having a textured top surface lying in a surface plane and a bottom surface lying in a bottom plane wherein there is a z-directional height difference between the surface plane and bottom plane; conveying the web through a first nip created by a first receiving roll and a pattern roll having a plurality of protuberances forming a design pattern; conforming a portion of the web to the protuberances; and conveying the web into a second nip formed between the pattern roll and a second receiving roll to form a patterned tissue product having a design element corresponding to the plurality of protuberances, the design element lying in a design element plane that is between the surface plane and the bottom plane.

In still other embodiments the present invention provides a method of manufacturing a tissue product comprising the steps of providing a fibrous structure having a machine direction and a cross-machine direction, a plurality of ridges defining a top surface lying in a surface plane, and a plurality of valleys defining a bottom surface lying in a bottom plane, wherein the ridges are separated from one another by valleys and there is a z-directional height difference between the surfaces, conveying the fibrous structure through a first nip to register a portion of the structure with a protuberance, conveying the fibrous structure through a second nip while the web remains in registration with the protuberance.

In still other embodiments the present invention provides a method of manufacturing a patterned tissue product comprising the steps of providing a tissue web having a textured top surface lying in a surface plane and a bottom surface lying in a bottom plane wherein there is a z-directional height difference between the surface plane and bottom plane; conveying the web through a first nip created by a first receiving roll and a pattern roll having a plurality of protuberances forming a design pattern; conforming a portion of the web to the protuberances; applying a chemical papermaking additive to an applicator roll; conveying the web through a second nip created by a the pattern roll and the applicator roll; applying the additive to the conformed portion of the web; and conveying the web into a third nip formed between the pattern roll and a second receiving roll to form a patterned tissue product having a design element corresponding to the plurality of protuberances, the design element lying in a design element plane that is between surface plane and the bottom plane.

In yet other embodiments the present invention provides a method of manufacturing a patterned tissue product comprising the steps of providing a tissue web having a textured top surface lying in a surface plane and a bottom surface lying in a bottom plane wherein there is a z-directional height difference between the surface plane and bottom plane; conveying the web through a first nip created by a first receiving roll and a pattern roll having a plurality of protuberances forming a design pattern; conforming a portion of the web to the protuberances whereby a portion of the web is registered with the protuberances; wetting the portion of the web in registration with the protuberances; and maintaining registration between the web and the protuberances while conveying the web through a second nip formed between the pattern roll and a second receiving roll to form a patterned tissue product having a design element corresponding to the plurality of protuberances, the design element lying in a design element plane that is between the surface plane and the bottom plane.

DESCRIPTIONS OF THE DRAWINGS

DEFINITIONS

Figure 1:
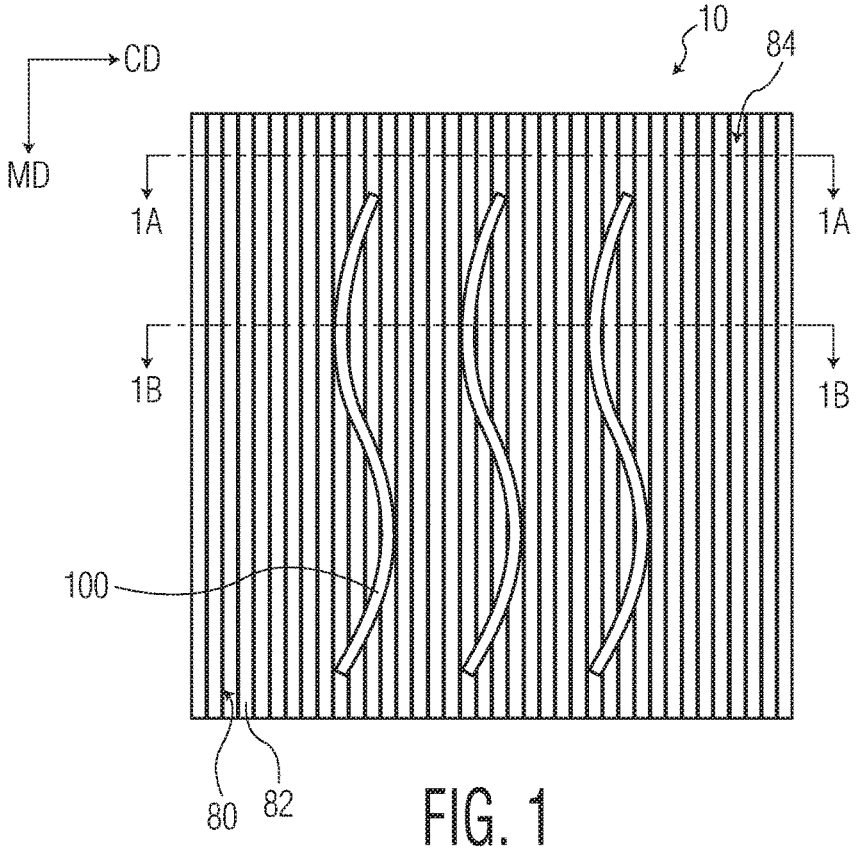
FIG. 1 is a plane view of a fibrous structure according to one embodiment of the present invention, with FIG. 1A and FIG. 1B representing cross-sectional views of the structure through lines 1A-1A and 1B-1B respectively.

As used herein the term "fibrous structure" refers to a structure comprising a plurality of elongated particulate having a length to diameter ratio greater than about 10 such as, for example, papermaking fibers and more particularly pulp fibers, including both wood and non-wood pulp fibers, and synthetic staple fibers. A non-limiting example of a fibrous structure is a tissue web comprising pulp fibers.

As used herein the term "basesheet" refers to a fibrous structure provided in sheet form that has been formed by any one of the papermaking processes described herein, but has not been subjected to further processing to convert the sheet into a finished product, such as subtractive texturing, embossing, calendering, perforating, plying, folding, or rolling into individual rolled products.

As used herein the term "tissue web" refers to a fibrous structure provided in sheet form and being suitable for forming a tissue product.

As used herein the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein the term "ply" refers to a discrete tissue web used to form a tissue product. Individual plies may be arranged in juxtaposition to each other.

As used herein the term "layer" refers to a plurality of strata of fibers, chemical treatments, or the like within a ply.

As used herein, the term "papermaking fabric" means any woven fabric used for making a tissue sheet, either by a wet-laid process or an air-laid process. Specific papermaking fabrics within the scope of this invention include wet-laid throughdrying fabrics and air-laid forming fabrics.

As used therein, the term "background surface" generally refers to the predominant overall surface of a fibrous structure, excluding the portions of the surface that are occupied by design elements.

As used herein, the term "textured surface" generally refers to at least one side of a fibrous structure wherein the surface has a three-dimensional topography with z-directional elevation differences between the upper surface planes of the fibrous structure. For example, in one non-limiting embodiment, the fibrous structure may comprise a plurality of line elements separated from one another by valleys. The upper surface of the line elements defining a surface plane and the upper surface of the valleys defining a bottom plane, where there is some z-direction elevation difference between the surface plane and the bottom plane. In certain instances the textured surface may be provided by the one or more papermaking fabrics during formation of the tissue web. Suitable textured surfaces include surfaces generally having alternating ridges and valleys or bumps, which in certain instances may be formed by the knuckles or other structures formed by overlapping warp and shute filaments of the papermaking fabrics used to form the web.

As used herein, the term "surface plane" generally refers to the plane formed by the highest points of the textured surface. The surface plane is generally determined by imaging a cross-section of the fibrous structure and drawing a line tangent to the highest point of its upper surface where the line is generally parallel to the x-axis of the fibrous structure and does not intersect any portion of the fibrous structure.

As used herein, the term "bottom plane" generally refers to the plane formed by the lowest points of the textured surface. The bottom plane is opposite the surface plane and generally constitutes the bottom surface of the fibrous structure, which may also be referred to as the machine contacting surface. The bottom plane is generally determined by imaging a cross-section of the fibrous structure and drawing a line tangent to the lowest point of its lower surface where the line is generally parallel to the x-axis of the fibrous structure and does not intersect any portion of the fibrous structure.

As used herein, the term "design element" means a decorative figure, icon or shape such as a line element, a flower, heart, puppy, logo, trademark, word(s) and the like. The design element comprises a portion of the fibrous structure lying out of plane with the surface and bottom planes. In certain embodiments the design element may result from compressing or subtracting a portion of the fibrous structure's textured surface resulting in a depressed area having a z-directional elevation that is lower than the surface plane of the fibrous structure. The depressed areas can suitably be one or more linear elements or other shapes.

As used herein, the term "design element plane" generally refers to the plane formed by the upper surface of the depressed portion of the fibrous structure forming the design element. Generally the design element plane lies between the surface and bottom planes. In certain embodiments fibrous structure of the present invention may have a single design element plane, while in other embodiments the structure may have multiple design element planes. The design element plane is generally determined by imaging a cross-section of the fibrous structure and drawing a line tangent to the upper most surface of a design element where the line is generally parallel to the x-axis of the fibrous structure.

As used herein the term "line element" refers to an element, such as a design element, in the shape of a line, which may be continuous, discrete, interrupted, and/or a partial line with respect to a fibrous structure on which it is present. The line element may be of any suitable shape such as straight, bent, kinked, curled, curvilinear, serpentine, sinusoidal, and mixtures thereof that may form regular or irregular periodic or non-periodic lattice work of structures wherein the line element exhibits a length along its path of at least 10 mm. In one example, the line element may comprise a plurality of discrete elements, such as dots and/or dashes for example, that are oriented together to form a line element.

As used herein the term "continuous element" refers to an element, such as a design element, disposed on a fibrous structure that extends without interruption throughout one dimension of the fibrous structure.

As used herein the term "discrete element" refers to an element, such as a design element, disposed on a fibrous structure that does not extend continuously in any dimension of the fibrous structure.

As used herein the term "basis weight" generally refers to the bone dry weight per unit area of a tissue and is generally expressed as grams per square meter (gsm). Basis weight is measured using TAPPI test method T-220. While basis weight may be varied, tissue products prepared according to the present invention generally have a basis weight greater than about 10 gsm, such as from about 10 to about 80 gsm and more preferably from about 30 to about 60 gsm.

As used herein the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa). The caliper of a tissue product may vary depending on a variety of manufacturing processes and the number of plies in the product, however, tissue products prepared according to the present invention generally have a caliper greater than about 100 μm, more preferably greater than about 200 μm and still more preferably greater than about 300 μm, such as from about 100 to about 1,500 μm and more preferably from about 300 to about 1,200 μm.

As used herein the term "sheet bulk" refers to the quotient of the caliper (generally having units of μm) divided by the bone dry basis weight (generally having units of gsm). The resulting sheet bulk is expressed in cubic centimeters per gram (cc/g). While sheet bulk may vary depending on any one of a number of factors, tissue products prepared according to the present invention may have a sheet bulk greater than about 5 cc/g, more preferably greater than about 8 cc/g and still more preferably greater than about 10 cc/g, such as from about 5 to about 20 cc/g.

As used herein, the terms "geometric mean tensile" and "GMT" refer to the square root of the product of the machine direction tensile strength and the cross-machine direction tensile strength of the tissue product. While the GMT may vary, tissue products prepared according to the present invention may have a GMT greater than about 500 g/3", more preferably greater than about 700 g/3" and still more preferably greater than about 1,000 g/3".

As used herein, the term "stretch" generally refers to the ratio of the slack-corrected elongation of a specimen at the point it generates its peak load divided by the slack-corrected gauge length in any given orientation. Stretch is an output of the MTS TestWorks™ in the course of determining the tensile strength as described in the Test Methods section herein. Stretch is reported as a percentage and may be reported for machine direction stretch (MDS), cross-machine direction stretch (CDS) or as geometric mean stretch (GMS), which is the square root of the product of machine direction stretch and cross-machine direction stretch. While the stretch of tissue products prepared according to the present invention may vary, in certain embodiments tissue products prepared as disclosed herein have a GMS greater than about 5 percent, more preferably greater than about 10 percent and still more preferably greater than about 12 percent.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "geometric mean slope" (GM Slope) generally refers to the square root of the product of machine direction slope and cross-machine direction slope. GM Slope generally is expressed in units of kilograms (kg). While the GM Slope may vary, tissue products prepared according to the present invention may have a GM Slope less than about 20 kg, and more preferably less than about 15 kg and still more preferably less than about 10 kg.

As used herein, the term "Stiffness Index" refers to GM Slope (having units of kg), divided by GMT (having units of g/3") multiplied by 1,000. While the Stiffness Index may vary, tissue products prepared according to the present invention may have a Stiffness Index less than about 10.0, more preferably less than about 8.0 and still more preferably less than about 7.0.

DESCRIPTION

The present invention provides a variety of novel fibrous structures having a design element disposed on at least one surface. More particularly the present invention provides fibrous structures comprising a textured surface, and more preferably a textured background surface, and a design element wherein the design element is formed by removing a portion of the textured background. In this manner the fibrous structures of the present invention generally comprise a textured background surface having a top surface lying in a surface plane, a bottom surface lying in a bottom plane and a design element lying in a third plane between the surface and bottom planes. The textured surface provides the fibrous structures with an overall background pattern that is typically visually distinct from the design element imparted thereon.

In certain embodiments the textured surface may comprise peaks defining a surface plane and valleys defining a bottom plane wherein a portion of the peaks may be removed by compressing a portion of the web. The compressed portion of the fibrous structure assumes a third plane, the design element plane, lying between the surface and bottom planes. In this manner the current method of imparting a design element to a fibrous structure is referred to herein as "subtractive texturing" and generally results in a structure having three principle planes—a surface plane, a design element plane and a bottom plane. The design element plane, which lies below the surface plane, provides the fibrous structure with a visually discernable design which users may find aesthetically pleasing.

As noted above, the design element plane lies below the surface plane and in certain preferred embodiments between the surface and bottom planes. In other embodiments, the design element may lie substantially in the same plane as the bottom plane such that the design element plane and the bottom plane are substantially coextensive. While the design element plane may lie between the surface and bottom planes or may be coextensive with the bottom plane, the design element plane does not lie above the surface plane or below the bottom plane. In this manner the present invention differs from conventional embossing, which generally results in a fibrous structure having design elements formed from portions of the structure exceeding either the surface or bottom planes. Further, because embossing results in a design element having an elevation that exceeds either the surface or bottom planes of the structure the caliper of the structure is increased.

Generally the fibrous structures of the present invention comprise at least one surface that is textured. Preferably the texture is imparted during the manufacturing process such as by wet texturing during formation of the web, molding the pattern into the web using a drying fabric or by embossing. Generally the textured surface is not the result of printing, which generally would not result in the fibrous structure having a three dimensional topography. In a particularly preferred embodiment, rather than having printed patterns, the instant fibrous structures have textured surfaces that are formed by embossing, wet molding and/or through-air-drying via an embossing roll, a fabric and/or a textured through-air-drying fabric.

Accordingly, in one embodiment, the textured surface is formed during the manufacturing process by molding the fibrous structure using an endless belt having a corresponding textured surface. For example, the fibrous structure may be manufactured using an endless belt which comprises a continuous three dimensional element (also referred to herein as a continuous line element) and a reinforcing structure (also referred to herein as a carrier structure or fabric). The reinforcing structure comprises a pair of opposed major surfaces—a web contacting surface from which the continuous line elements extend and a machine contacting surface. Machinery employed in a typical papermaking operation is well known in the art and may include, for example, vacuum pickup shoes, rollers, and drying cylinders. In one embodiment the belt comprises a through-air drying fabric useful for transporting an embryonic tissue web across drying cylinders during the tissue manufacturing process. In such embodiments the web contacting surface supports the embryonic tissue web, while the opposite surface, the machine contacting surface, contacts the through-air dryer.

In certain embodiments a plurality of continuous line elements may be disposed on the web-contacting surface for cooperating with, and structuring of, the wet fibrous web during manufacturing. In a particularly preferred embodiment the web contacting surface comprises a plurality of spaced apart three dimensional elements distributed across the web-contacting surface of the carrier structure and together constituting from at least about 15 percent of the web-contacting surface, such as from about 15 to about 35 percent, more preferably from about 18 to about 30 percent, and still more preferably from about 20 to about 25 percent of the web-contacting surface.

Figure 1A:
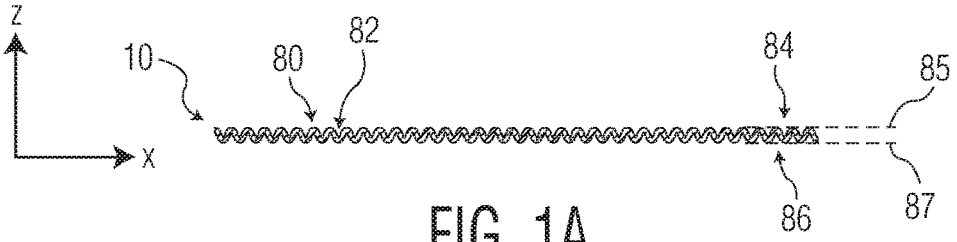
Figure 1B:
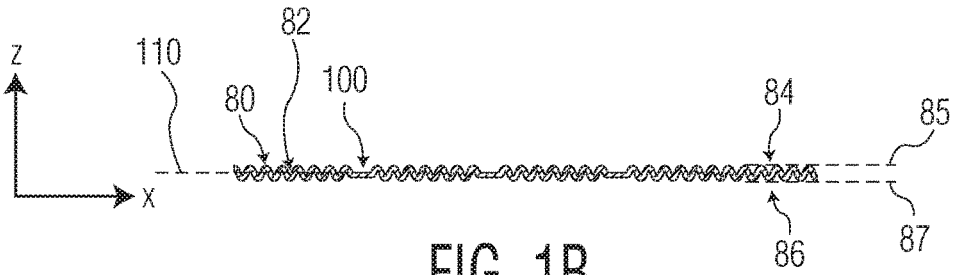

Now with reference to FIGS. 1, 1A and 1B, one embodiment of a fibrous structure 10 prepared according to the present invention is illustrated. The fibrous structure 10 has two principle dimensions—a machine direction ("MD"), which is the direction substantially parallel to the principal direction of travel of the tissue web during manufacture and a cross-machine direction ("CD"), which is generally orthogonal to the machine direction. The fibrous structure generally has a three dimensional surface defined by ridges. The fibrous structure 10 comprises a plurality of continuous elevated line elements 80 and a plurality of valleys 82 there-between.

Generally the elevated line elements 80 are coextensive with the surface plane 85, also referred to herein as a top surface plane or upper surface plane. The surface plane 85 defines the upper surface 84 of the fibrous structure 10. Opposite the upper surface 84 is the bottom surface 86 of the fibrous structure 10. The bottom surface 86 is generally defined by the bottom surface plane 87, also referred to herein as a bottom plane, which is coextensive with the valleys 82 lying between the peaks 80. While the instant fibrous structure is illustrated as having alternating peaks and valleys which define the surface and bottom planes and provide the structure with a textured surface, the invention is not so limited. One skilled in the art will appreciate that there are numerous structures which may be employed to yield a fibrous structure having a three-dimensional topography with z-directional elevation difference between the surface and bottom planes.

With reference to FIG. 1B the fibrous structure 10 comprises a plurality of alternating line elements 80 and valleys 82 which provides the structure with a three-dimensional topography generally defined as the difference in height between the upper surface plane 85 and the bottom surface plane 87. The fibrous structure 10 further comprises a design element 100. The design element 100 has an upper surface 105 lying in a third plane 110 (also referred to herein as the design element plane), which in a preferred embodiment lies between the upper surface plane 85 and the bottom surface plane 87.

Figure 2:
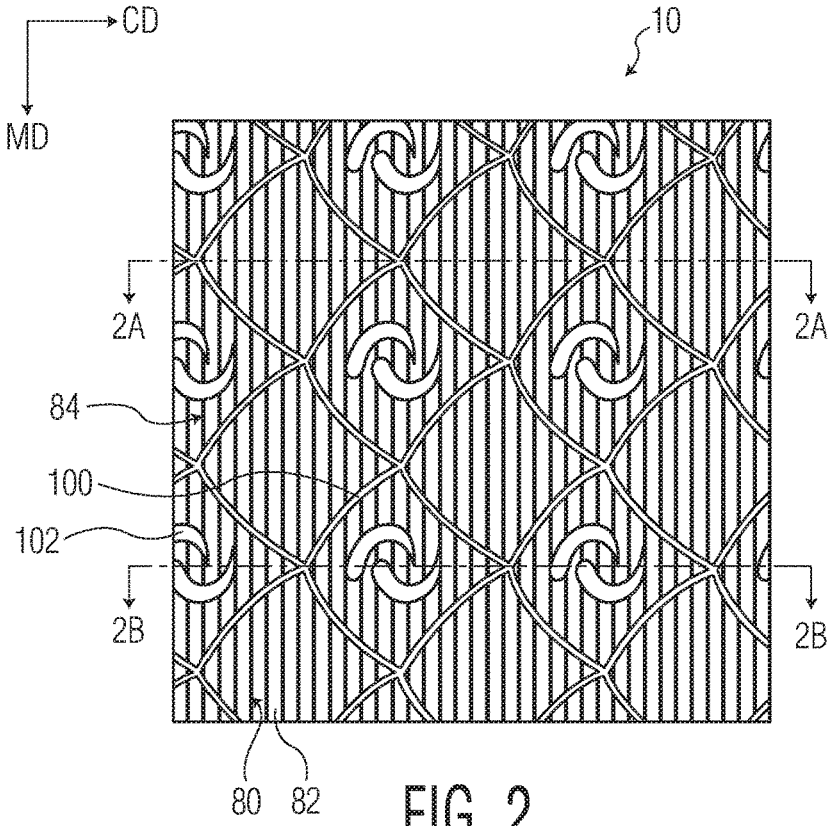
FIG. 2 is a plane view of a fibrous structure according to another embodiment of the present invention, with FIG. 2A and FIG. 2B representing cross-sectional views of the structure through lines 2A-2A and 2B-2B respectively.
Figure 2A:
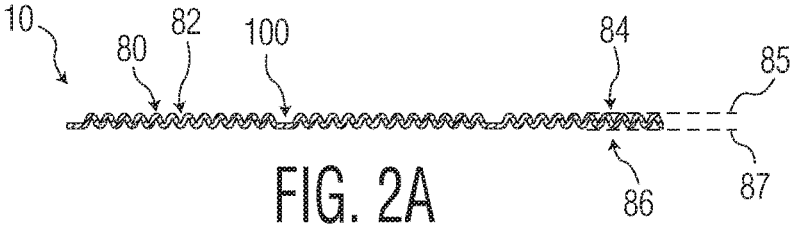
Figure 2B:
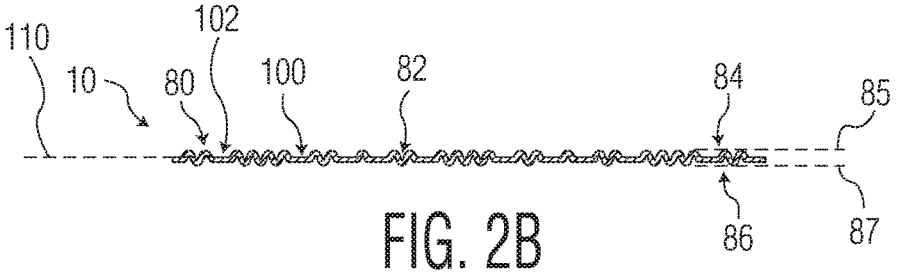

Turning now to FIGS. 2, 2A and 2B, another embodiment of a fibrous structure prepared according to the present invention is illustrated. The fibrous structure 10 comprises a first design element 100 and a second design element 102, which form a repeating pattern. The first and second design elements 100, 102 are formed by subtracting a portion of the line elements 80 resulting in design elements 100, 102 lying in a design element plane 110 between the upper surface plane 85 and the bottom surface plane 87.

Figure 3:
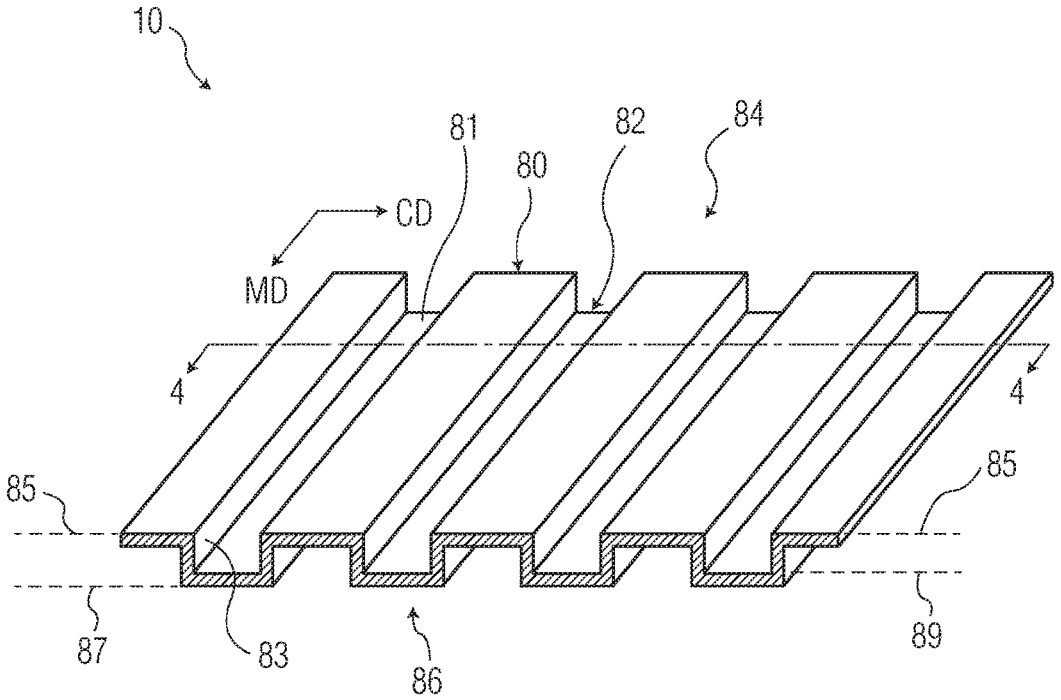
FIG. 3 is a perspective view of a fibrous structure having a textured surface useful in the present invention.

Turning now to FIG. 3, which illustrates a fibrous structure useful in forming a structure bearing a design element according to the present invention. The fibrous structure illustrated in FIG. 3, which has not yet been imparted with a design element, has a top surface 84, which may also be referred to herein as the machine contacting surface or air contacting surface, depending on the method of manufacture, and an opposed bottom surface 86, which may also be referred to herein as the fabric contacting surface. The top surface 84 has an upper plane 85 lying in a first elevation and defined by the upper surface of the continuous line elements 80. The bottom surface 86 has a bottom surface plane 87 lying in a second elevation defined by the lower surface of the valleys 82 lying between the line elements 80. The continuous line elements 80 further comprise spaced apart sidewalls 83 that extend in the z-direction and in certain embodiments may be generally orthogonal to the bottom plane 87.

In the embodiment illustrated in FIG. 3 the continuous line elements 80 are similarly sized and have generally straight, parallel spaced apart sidewalls 83 providing the continuous elements 80 with a width, and a height. The width and the height may be varied depending on the desired physical properties of the fibrous structure, such as sheet bulk and cross-machine direction stretch. In certain embodiments the height of the sidewalls is such that the resulting tissue structure has a caliper greater than about 300 μm, such as from about 300 to about 1,200 μm. The height is generally measured as the distance between the surface plane 85 (defined by the outer surface of the line elements 80) and the valley upper 82 surface plane 89.

The spacing and arrangement of the continuous line elements may vary depending on the desired tissue product properties and appearance. In one embodiment a plurality of line elements extend continuously throughout one dimension of the fibrous structure and each element in the plurality is spaced apart from the adjacent element. Thus, the elements may be spaced apart across the entire cross-machine direction of the fibrous structure or may run diagonally relative to the machine and cross-machine directions. Of course, the directions of the line elements alignments (machine direction, cross-machine direction, or diagonal) discussed above refer to the principal alignment of the elements. Within each alignment, the elements may have segments aligned at other directions, but aggregate to yield the particular alignment of the entire elements.

Figure 4:
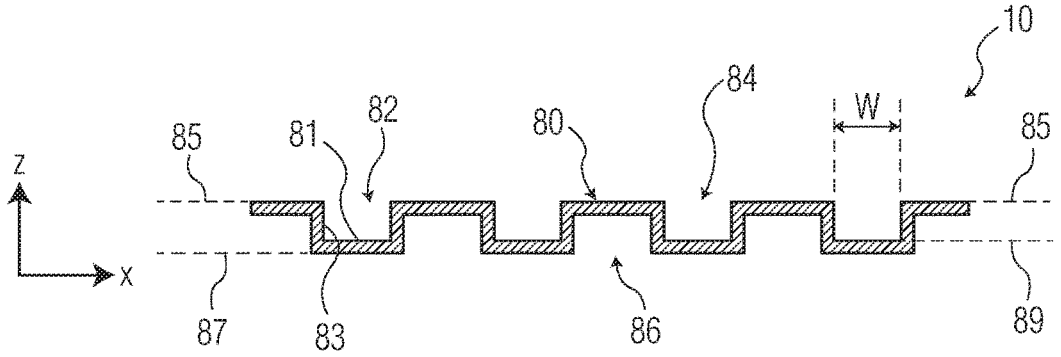
FIG. 4 is a cross-sectional view of the fibrous structure of FIG. 3 through the line 4-4.

In addition to varying the spacing and arrangement of the elements, the shape of the element may also be varied. For example, in one embodiment, the elements are substantially sinusoidal and are arranged substantially parallel to one another such that none of the elements intersect one-another. As such the adjacent sidewalls of individual elements are equally spaced apart from one another. In such embodiments, the spacing of elements (illustrated as W in FIG. 4) may be from about 1.0 to about 20 mm, and more preferably from about 2.0 to about 5.0 mm apart. The foregoing spacing may be optimized to maximum caliper of the fibrous structure, or provide a fibrous structure having a three dimensional surface topography, yet relatively uniform density. Further, while in certain embodiments the elements are continuous the invention is not so limited. In other embodiments the elements may be discrete.

Figure 5:
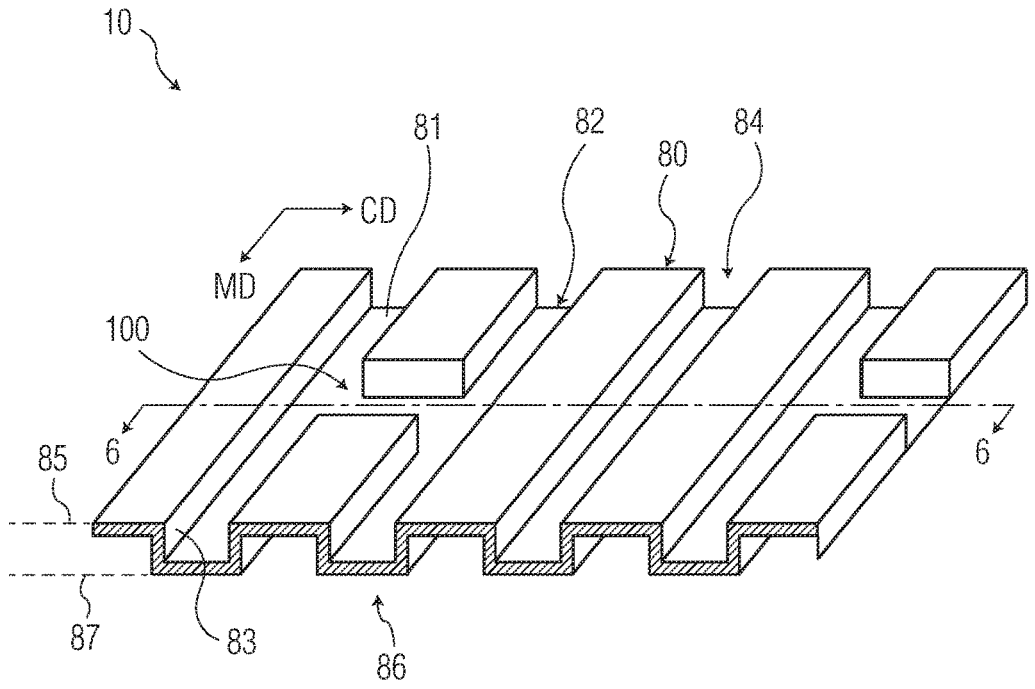
FIG. 5 is a perspective view of a fibrous structure according to one embodiment of the present invention.
Figure 6:
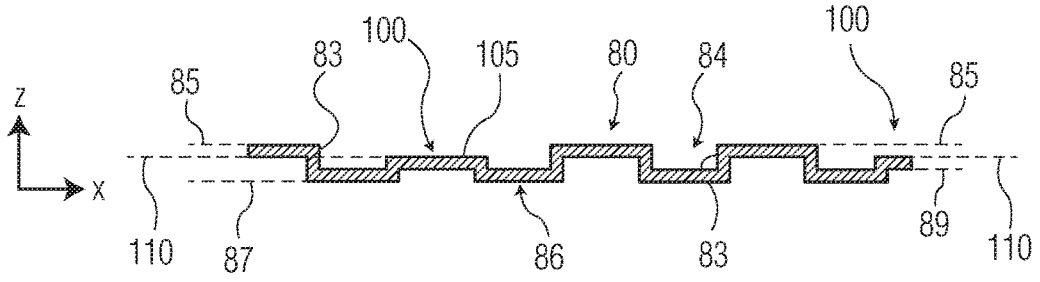
FIG. 6 is a cross-sectional view of the fibrous structure of FIG. 5 through the line 6-6.

With reference now to FIGS. 5 and 6, one embodiment of a fibrous structure 10 having a design element 100 according to the present invention is illustrated. The fibrous structure 10 has a textured surface of alternating continuous line elements 80 and valleys 82. The valley elements 82 have a z-directional height which is generally measured as the distance between the upper surface plane 85 and the valley's upper surface plane 89. The design elements 100 are formed by subtracting a portion of the line elements 80 and as a result the design elements 100 lie in a third plane, the design element plane 110, between the upper surface plane 85 and the bottom surface plane 87.

While the design elements 100 are illustrated as having a square horizontal and lateral (relative to the upper surface plane) cross-sectional shape the invention is not so limited and the design element 100 may have any number of different horizontal and lateral cross-sectional shapes. A particularly preferred design element 100 has planar sidewalls which are generally perpendicular to the upper surface plane 85. Further, while the upper surface 105 of the design element is illustrated as being planar and defining a design element plane 110, the invention is not so limited. For example, the design element's upper surface 105 may be non-planar, such as having further depressions in the form of lines or dots disposed thereon. Where the design elements 100 upper surface 105 is non-planar the design element plane 110 is generally defined by a line drawn tangent to the upper most point of the design element and parallel to the x-axis of the fibrous structure 10.

The individual design elements may be arranged in any number of different manners to create a decorative pattern. In one particular embodiment design elements are spaced and arranged in a non-random pattern so as to create a wave-like design. Landing areas may be interspaced between adjacent individual design elements so as to provide a visually distinctive interruption to the decorative pattern formed by the individual spaced apart design elements. In this manner, despite being discrete elements, the design elements are spaced apart so as to form a visually distinctive curvilinear decorative element that extends substantially in the machine direction. In this manner, taken as a whole, the discrete elements may form a decorative pattern, such as a wave-like pattern.

In other embodiments the design elements may be spaced and arranged so as to form a decorative figure, icon or shape such as a flower, heart, puppy, logo, trademark, word(s) and the like. Generally the design elements are spaced about the fibrous structure and can be equally spaced or may be varied such that the density and the spacing distance may be varied amongst the design elements. For example, the density of the design elements can be varied to provide a relatively large or relatively small number of design elements on the web. In a particularly preferred embodiment the design element density, measured as the percentage of one surface of the fibrous structure covered by a design element, is from about 5 to about 35 percent and more preferably from about 10 to about 30 percent. Similarly the spacing of the design elements can also be varied, for example, the design elements can be arranged in spaced apart rows. In addition, the distance between spaced apart rows and/or between the design elements within a single row can also be varied.

Fibrous structures having textured surfaces which may be imparted with a design element of the present invention may be formed using any one of several well-known manufacturing processes. For example, in certain embodiments, fibrous structures may be produced by a through air drying (TAD) manufacturing process, an advanced tissue molding system (ATMOS) manufacturing process, a structured tissue technology (STT) manufacturing process, or belt creped. In particularly preferred embodiments the fibrous structure is manufactured by a creped through-air dried (CTAD) process or uncreped through-air dried (UCTAD) process.

In one embodiment, tissue webs useful in the present invention are formed by the UCTAD process of: (a) depositing an aqueous suspension of papermaking fibers (furnish) onto an endless forming fabric to form a wet web; (b) dewatering or drying the web; (c) transferring the web to a transfer fabric; (d) transferring the web to a TAD fabric of the present invention having a pattern thereon; (e) deflecting the web wherein the web is macroscopically rearranged to substantially conform the web to the textured background pattern of the TAD fabric; and (f) through-air drying the web. In the foregoing process the web is not subject to creping, but may be further processed as described below to impart a design pattern to the web.

After forming of a fibrous structure having a textured surface, a design element may be imparted on the fibrous structure by passing the fibrous structure through a nip created by a pattern roll bearing a mirror image of the design element and a backing roll. As the web passes through the nip a portion of the textured surface is removed or subtracted to create the design element.

Passing the fibrous structure though a nip to impart the design element may compress the web resulting in a reduction in the caliper of the web. For example, in certain embodiments the caliper of the web may be reduced from about 2.0 to about 40 percent and more preferably from about 2.0 to about 20 percent. Thus, a tissue product having a design element imparted by the present invention may have a sheet bulk that is slightly reduced compared to the basesheet from which it is prepared. For example, in certain embodiments the sheet bulk of the patterned tissue product may be from about 2.0 to about 40 percent and more preferably from about 2.0 to about 20 percent less than the basesheet.

While in certain embodiments the caliper or bulk of the basesheet may be reduced when a pattern is imparted onto the basesheet, in other embodiments there may be no change in the caliper or bulk. As such the finished product may have a design element, but the bulk or caliper may be substantially the same as the basesheet.

Regardless of whether the caliper and bulk of the basesheet are preserved or reduced, the present invention generally differs from conventional embossing, which imparts the finished product with a design while increasing caliper and bulk. Thus, unlike conventional embossing which is used to increase the caliper and bulk of the basesheet to yield a bulkier finished product, the present invention generally provides finished products having bulks that are comparable or slightly reduced compared to the basesheets from which they are prepared.

In one particularly preferred embodiment a design element is imparted to a single ply tissue web by passing the tissue web having a textured surface through a first nip between a first substantially smooth roll and a patterned roll and a then a second nip between the patterned roll and a second substantially smooth roll. As the single ply textured web passes through the first and second nips a portion of the texture is removed by compressing the web. In this manner the z-directional height of the web is reduced in those areas contacted by the patterned roll resulting in a web having at least three principle planes—a surface plane, a bottom plane and a design element plane. Generally the design element plane lies between the surface and bottom planes and defines a visibly recognizable design on the single ply tissue product.

Figure 7:
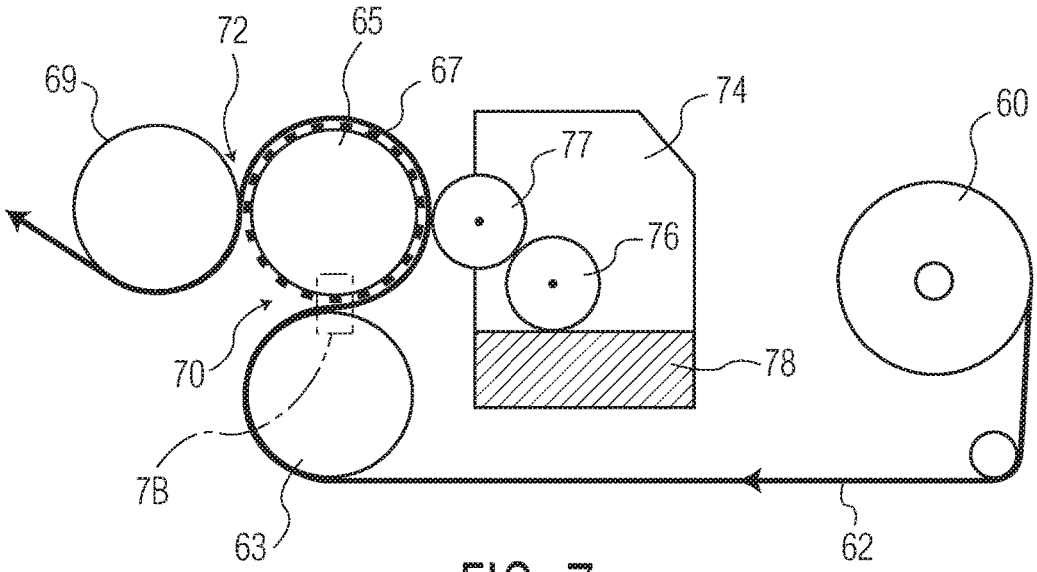
FIG. 7 is an illustration of an apparatus useful in forming the fibrous structures of the present invention with FIG. 7B illustrating a detail view of the nip 70.

Fibrous structures having a design element may be produced using an apparatus similar to that shown in FIG. 7. The apparatus includes an unwind roll 60 on which is wound a tissue web 62. As it is unwound the web passes from the unwind roll 60 to a receiving roll 63. The receiving roll 63 may be a substantially smooth roll and more preferably a smooth roll having a covering, or made of, natural or synthetic rubber, for example, polybutadiene or copolymers of ethylene and propylene or the like.

In a preferred embodiment of the present invention, the receiving roll 63 has a hardness greater than about 40 Shore (A), such as from about 40 to about 100 Shore (A) and more preferably from about 40 to about 80 Shore (A). By providing a receiving roll with such hardness, the designs of the pattern roll are not pressed into the decoration backing roll as deep as in conventional apparatuses. Consequently, in those regions of the fibrous structure not contacted by the pattern roll elements the structure is subject to less compression and the overall caliper of the fibrous structure may be better preserved.

Figure 7B:
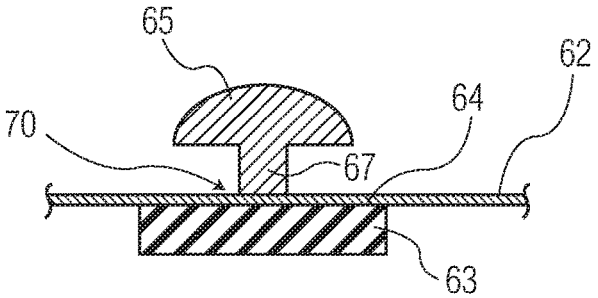

The web 62 is then passed between the receiving roll 63 and a patterned roll 65. The patterned roll 65 is generally a hard and non-deformable roll, such as a steel roll. The receiving roll 63 and pattern roll 65 are urged together to form a nip 70 (illustrated in detail in FIG. 7B) through which the web 62 passes to impose a design on the web. The pattern roll 65 comprises a plurality of protuberances shown representatively at 67. For illustrative purposes, the protuberances shown are exaggerated in comparison to the size of the rolls. Typically, the protuberances extend on the order of from about 0.5 to about 3.0 mm, such as from about 1.0 to about 2.0 mm from the surface of the roll. In addition, typically the roll will include many more protuberances than that shown in FIG. 7. The protuberances may be of any desired shape, such as a simple rectangular shape for providing numerous small rectangular designs on a web, or somewhat intricate designs or patterns, to impart floral or other decorative designs into the web.

In other embodiments the height from which the protuberances extend from the surface of the pattern roll may be varied so as to provide the resulting fibrous structure with design elements having differing design element planes. While the design elements may have more than one plane, it is generally preferred that the height of the protuberance be such that none of the design element planes exceed the top surface plane or the bottom surface plane of the fibrous structure. In this variation, where differing protuberance heights are employed some of the design elements are deeper, relative to the top surface plane of the structure, than others. In addition to different depth, the different depth design elements can be of a different configuration to impart an attractive appearance to the finished tissue product. For example, a first design element in the form of a discrete line may be provided lying in a first design element plane and a second design element in the form of a dot may be provided lying in a second design element plane. This could be easily achieved by appropriately configuring the outer surface of the patterned roll to have protuberances corresponding to the various design elements and elevations.

Force or pressure is applied to one or both of the rolls 63, 65, such that the rolls 63, 65 are urged against one another.

The pressure will cause the receiving roll 63 to deform about the protuberances 67, such that the web is pressed about the protrusion and onto the land areas (i.e. the outer surface areas of the roll 65 surrounding the protuberances 67), thereby removing a portion of the webs texture and imparting a design element to the web.

After passing through the nip 70 between the patterned roll 65 and the receiving roll 63, in certain embodiments, the web 62 may be brought into contact with water 78. Without being bound by any particular theory it is believed that by applying a relatively small amount of water, such as less than about 2 percent by weight of the web, after the design element has been imparted to the web, but before the web passes through a second nip, may further enhance deformation of the web as it passes through the second nip.

Further, though unknown, it is believed by the inventors that polymeric components of the cellulosic fibers forming the web, such as hemicellulose, cellulose or lignin, may be affected by the application of water prior to passing through a second nip. The application of water may result in the treated areas taking a more amorphous, glassy condition during the process. The process can therefore provide an improved, glassine appearance to the design elements imparted by the pattern roll. Thus, in certain embodiments, the present invention provides a fibrous structure having design elements which have a lower opacity relative to other areas of the structure.

In other embodiments the design element may have a different texture than the surrounding surface of the fibrous structure as a result of the design element being formed by subtracting a portion of the textured surface through the application of force. For example, in one embodiment the invention provides a fibrous structure with an overall textured background pattern having a first surface smoothness and a design element having a second surface smoothness where the surface smoothness of the design element is greater than the smoothness of the overall textured background pattern. For example, the fibrous structure may have an overall textured background pattern having a coefficient of friction (MIU) about 10 percent greater than the MIU of the design element, such as from about 10 to about 40 percent greater, and more preferably from about 20 to about 30 percent greater. In other embodiments the overall textured background may have an MIU (also referred to as Surface Smoothness) from about 0.20 to about 0.40 and more preferably from about 0.25 to about 0.40 and the design element may have an MIU from about 0.10 to about 0.30 and more preferably from about 0.15 to about 0.25.

In yet other embodiments the design element may have a different density than the surrounding surface of the fibrous structure as a result of the design element being formed by subtracting a portion of the textured surface through the application of force. For example, in one embodiment the invention provides a fibrous structure with an overall textured background pattern having a first density and a design element having a second density where the density of the design element is greater than the density of the overall textured background pattern.

As further illustrated in FIG. 7, a chemical papermaking additive may be applied to the web by a dispenser 74 which applies an additive 78 to the external side of the web 62. The dispenser 74 includes a reservoir for receiving and storing the additive, an applicator cylinder 77 and a dipping cylinder 76. The applicator cylinder 77 abuts the web 62 against the patterned roll 65. The dipping cylinder 76 picks up the additive 78 and transfers the additive 78 to the applicator cylinder 77. The applicator cylinder 77 may be arranged to exercise a determined pressure on the patterned roll 65 at the distal area of the design elements created by the protuberances 67.

Application of the chemical papermaking additive after the web has passed through the first nip and while it is supported by the pattern roll provides the advantage of applying the additive selectively to the planar areas of the design element. In this manner the chemical papermaking additive is only applied to those regions of the web corresponding to the pattern roll protuberances and therefore a relatively small percentage of the web surface area may be treated. This selective disposition of additive is advantageous from the standpoint of not excessively relaxing the web or altering the degree of fiber-fiber bonding developed during formation of the web. Also, by selectively applying the additive to the planar surface area of the design elements, rewetting of the web may be limited and additional drying steps may be omitted.

In a further embodiment, where the fibrous structure has design elements having different design element planes, such as a first design element lying in a first design element plane and a second design element lying in a second design element plane, the apparatus may be configured to apply water to only the highest design element plane. That is, through use of an offset roll application device such as that shown in FIG. 7, water is applied only to the highest design element plane forming a part of the overall design. Thus, water may be applied in very small selected areas so as not to significantly interfere with the perceived softness of the resulting sheet and, in certain embodiments, provide a tissue product having a first and a second design element having different opacity or surface smoothness.

In other embodiments water may be applied to the web in the form of steam by passing the web over an apparatus emitting steam. The amount of steam applied can vary, although it is preferably less than approximately 3 percent by weight of the web, more preferably less than 2 percent by weight.

The chemical papermaking additives may be applied to the web according to the present invention such that less than about 30 percent of the surface area of the web is treated, such as from about 5.0 to about 30 percent and more preferably from about 10 to about 20 percent. Further, the add-on of chemical additives (on a solids basis) relative to the dry fiber weight of the web can be less than about 5.0 percent, by weight of the web, such as from about 1.0 to about 5.0 percent and more preferably from about 2.0 to about 3.0 percent.

In particularly preferred embodiments a physical property of the product, such as, softness may be altered by applying a papermaking chemical additive. For example, a softening agent may be applied in registration with the design element to improve the softness of the finished product. The softening agent may comprise, for instance, a silicone. Although silicones make the tissue webs feel softer, silicones can be relatively expensive and may lower sheet durability as measured by tensile strength and/or tensile energy absorbed. Thus, it is preferred that softening agents, such as silicone, be selectively applied to only a portion of the web and at relatively low add-on levels. Thus, in one embodiment the invention provides a method of topically treating a web with a softening agent, such as a silicone, wherein less than about 30 percent of the surface area of the web is treated, such as from about 5.0 to about 30 percent and more preferably from about 10 to about 20 percent. Further, the add-on of softener (on a solids basis) relative to the dry fiber weight of the web can be less than about 5.0 percent, by weight of the web, such as from about 1.0 to about 5.0 percent and more preferably from about 2.0 to about 3.0 percent.

With reference again to FIG. 7, after exiting the first nip 70 the web 62 remains in registration with the pattern roll 65 protuberances 67 as the design element portion of the web 62 remains supported by the protuberances 67 as it is conveyed towards a second nip 72 formed between pattern roll 65 and a substantially smooth roll 69. The substantially smooth roll 69 is generally a hard and non-deformable roll, such as a steel roll. As the web 62 enters the second nip 72 subtractive texturing of the web 62 is completed by the application of pressure and the compression of the textured background surface to create the design element, which will ultimately reside in plane between the top surface plane and bottom plane of the web.

The second receiving roll may be a substantially smooth roll or may have a non-smooth surface. In certain embodiments the surface of the receiving roll may include indentations that correspond to the pattern roll protuberances. Further, the second receiving roll may be either a firm roll formed from steel or the like or may be flexible, such as a roll with a soft covering such as rubber or polyurethane.

In certain embodiments the second receiving roll is provided with a deflection compensated means such as a deflection compensated roll or a system of sensors and actuators that may be used for nip load and nip inclination adjustment by pneumatic valves or by valves controlled via display of an automatic control system.

In still other embodiments the deflection of the second receiving roll is controlled by employing an apparatus such as that taught in U.S. Pat. No. 8,312,909, the contents of which are incorporated herein in a manner consistent with the present invention. For example, both the second receiving roll and the patterned roll may be provided with a fixed central shaft supported by a corresponding holder at each end thereof, on which shaft a tubular jacket is fitted for contacting the web, with the interposition of low-friction connecting members on opposite sides with respect to a center line of a fixed central shaft axis. In this manner the tubular jacket is free to rotate about a longitudinal axis thereof.

Generally the pressure applied at the second nip may be greater than about 30 pli, such as from about 50 to about 250 pli, and more preferably from about 100 to about 250 pli.

Accordingly, in one preferred embodiment, fibrous structures having a design element may be produced by forming a textured tissue web, conveying the web through a first nip created by a substantially smooth rubber roll and a steel pattern roll having a plurality of protuberances corresponding to the design element. As the web passes through the first nip it is partially conformed to the protuberances such that the contacted areas are raised above the surface plane of the textured web. The web, supported by the pattern roll, is then conveyed to an applicator roll which applies a small amount of water to the raised areas of the web in contact with the applicator roll. The now moistened web, continuing to be supported by the patterned roll, is then conveyed further into a second nip formed between the pattern roll and a second receiving roll. The second receiving roll imparts sufficient pressure to permanently impress the design elements into the web creating a design element having a design element plane that generally lies between the top surface plane and the bottom plane of the web.

Tissue webs and products produced according to the present invention not only have a design element that may be aesthetically pleasing to a consumer, they may also have favorable physical properties, such as sufficient strength to withstand use without being stiff or rough. Accordingly, in one embodiment the present invention provides a tissue product comprising a single ply tissue product comprising a fibrous structure having a textured top surface lying in a surface plane, a bottom surface lying in a bottom plane, and a design element lying in a design element plane, wherein there is a z-directional height difference between the surface and bottom planes and the design element plane lies between the surface and bottom planes and wherein the tissue product has a basis weight from about 10 to about 80 gsm, and more preferably from about 15 to about 60 gsm and a sheet bulk greater than about 5 cc/g, such as from about 5 to about 20 cc/g and more preferably greater than about 10 cc/g, such as from about 10 to about 20 cc/g.

In addition to having the foregoing basis weights and sheet bulks, tissue webs and products prepared according to the present invention may have a geometric mean tensile (GMT) greater than about 500 g/3", such as from about 500 to about 1,500 g/3", and more preferably from about 600 to about 1,000 g/3". At these tensile strengths the tissue webs and products have relatively low geometric mean modulus, expressed as GM Slope, so as to not overly stiffen the tissue product. Accordingly, in certain embodiments, tissue webs and products may have GM Slope less than about 20 kg, and more preferably less than about 15 kg and still more preferably less than about 10 kg.

In one particularly preferred embodiment the present invention provides a rolled bath tissue product comprising a single ply through-air dried tissue web having a basis weight from about 20 to about 45 gsm, a GMT from about 500 to about 1,200 g/3", a GM Slope less than about 12 kg, such as from about 5.0 to about 12 kg, and a GM Stretch greater than about 5 percent, such as from about 5 to about 15 percent. The foregoing rolled bath tissue product comprises a textured top surface lying in a surface plane, a bottom surface lying in a bottom plane, and a design element lying in a design element plane, wherein there is a z-directional height difference between the surface and bottom planes and the design element plane lies between the surface and bottom planes. Preferably the rolled tissue product has a caliper greater than about 300 μm, such as from about 300 to about 1,000 μm and the z-directional height difference between the surface plane and the bottom plane element is at least about 300 μm, such as from about 300 to about 1,000 μm and more preferably from about 200 to about 600 μm. Further, in a particularly preferred embodiment, the design element plane lies between the surface and bottom planes and is from about 100 to about 300 μm and more preferably from about 150 to about 250 μm below the surface plane.

In another embodiment the present invention provides a rolled paper towel product comprising a single ply through-air dried tissue web having a basis weight from about 20 to about 60 gsm and more preferably from about 30 to about 50 gsm, a GMT from about 1,500 to about 3,500 g/3" and more preferably from about 1,800 to about 2,700, a GM Slope less than about 12 kg, such as from about 5.0 to about 12 kg and a GM Stretch greater than about 5 percent, such as from about 5 to about 15 percent. The foregoing towel product comprises a textured top surface lying in a surface plane, a bottom surface lying in a bottom plane, and a design element lying in a design element plane, wherein there is a z-directional height difference between the surface and bottom planes and the design element plane lies between the surface and bottom planes. Preferably the towel product has a caliper greater than about 500 μm, such as from about 500 to about 1,200 μm and the z-directional height difference between the surface plane and the design element is at least about 100 μm, such as from about 100 to about 300 μm.

The inventive single ply tissue webs may be plied together with other single ply webs prepared according to the present disclosure or with single ply webs of the prior art to form multi-ply tissue products using any ply attachment means known in the art, such as mechanical crimping or adhesive.

When two or more inventive tissue webs are joined together the resulting multi-ply tissue product generally has a basis weight greater than about 40 gsm, such as from about 40 to about 80 gsm, and more preferably from about 50 to about 60 gsm. At these basis weights the tissue products generally have calipers greater than about 300 μm, such as from about 300 to about 1,200 μm, and more preferably from about 400 to about 1,000 μm. The tissue products further have sheet bulks greater than about 5 cc/g, such as from about 5 to about 20 cc/g and more preferably from about 10 to about 20 cc/g.

While being bulky and substantive enough to have multiple applications the tissue products are also strong enough to withstand use, but have relatively low modulus so as not to be overly stiff. For example, in certain embodiments the foregoing multi-ply tissue products have GMT greater than about 800 g/3", such as from about 800 to about 1,200 g/3". At these tensile strengths the tissue products generally have GM Slopes less than about 15.0 kg/3", such as from about 10.0 to about 15.0 kg/3", and more preferably from about 12.0 to about 14.0 kg/3".

Test Methods

Surface Smoothness

The surface properties of samples were measured on KES Surface Tester (Model KE-SE, Kato Tech Co., Ltd., Kyoto, Japan). For each sample the surface smoothness was measured according to the Kawabata Test Procedures with samples tested along the machine direction (MD) and cross machine direction (CD) and on both sides for five repeats with a sample size of 10 cm×10 cm. Care was taken to avoid folding, wrinkling, stressing, or otherwise handling the samples in a way that would deform the sample. Samples were tested using a multi-wire probe of 10 mm×10 mm consisting of 20 piano wires of 0.5 mm in diameter each with a contact force of 25 grams. The test speed was set at 1.0 mm per second. The sensor was set at "H" and FRIC was set at "DT". The data was acquired using KES-FB System Measurement Program KES-FB System Ver. 7.09 E for Win98/2000/XP by Kato Tech Co., Ltd., Kyoto, Japan. The selection in the program was "KES-SE Friction Measurement".

KES Surface Tester determined the coefficient of friction (MIU) and mean deviation of MIU (MMD), where higher values of MIU indicate more drag on the sample surface and higher values of MMD indicate more variation or less uniformity on the sample surface.

The values of MIU and MMD are defined by:

$$MIU(\bar{\mu})=1/X\int_0^x \mu dx$$

$$MMD=1/X\int_0^x |\mu-\bar{\mu}| dx$$

where

μ=friction force divided by compression force $\bar{\mu}$=mean value of μ x=displacement of the probe on the surface of specimen, cm

X=maximum travel used in the calculation, 2 cm

The cross machine (CD) and machine direction (MD) MMD values of the top and bottom surface of each tissue product sample was tested five times. The results of five sample measurements were averaged and reported as the MMD-CD and MMD-MD. The square root of the product of MMD-CD and MMD-MD was reported as Surface Smoothness.

Tensile

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six representative specimens are tested for each product, taken "as is," and the arithmetic average of all individual specimen tests is either the MD or CD tensile strength for the product.

EXAMPLES

Example 1

A single ply tissue product was produced using a through-air dried papermaking process commonly referred to as "uncreped through-air dried" ("UCTAD") and generally described in U.S. Pat. No. 5,607,551, the contents of which are incorporated herein in a manner consistent with the present disclosure.

Tissue basesheets were produced from a furnish comprising northern softwood kraft and *eucalyptus* kraft using a layered headbox fed by three stock chests such that the webs having three layers (two outer layers and a middle layer) were formed. The two outer layers comprised *eucalyptus* and the middle layer comprised softwood. The 3-layered structure had a furnish split of 33% EHWK/34% NBSK/33% EHWK, all on a weight percent basis.

The tissue web was formed on a Voith Fabrics TissueForm V forming fabric, vacuum dewatered to approximately 25 percent consistency and then subjected to rush transfer when transferred to the transfer fabric. The transfer fabric was the fabric described as "Fred" in U.S. Pat. No. 7,611,607 (commercially available from Voith Fabrics, Appleton, Wis.).

The web was then transferred to a through-air drying fabric. The through-air drying fabric was a silicone printed fabric described previously in co-pending PCT Appl. No. PCT/US2013/072220. Transfer to the through-drying fabric was done using vacuum levels of greater than 10 inches of mercury at the transfer. The web was then dried to approximately 98 percent solids before winding.

The basesheet was calendered using a conventional polyurethane/steel calender system comprising a 40 P&J polyurethane roll on the air side of the sheet and a standard steel roll on the fabric side at a loading of 40 pli.

Figure 8:
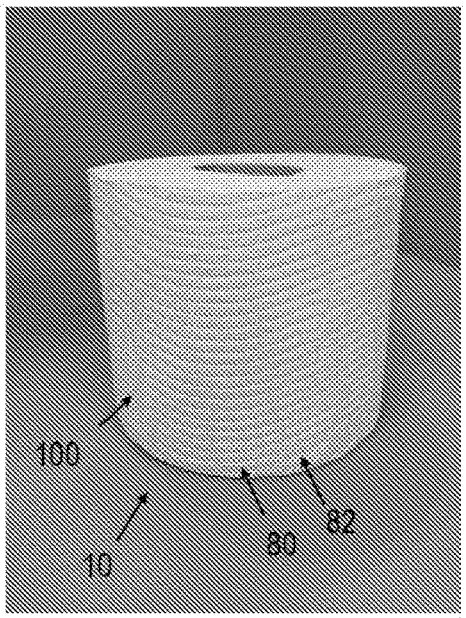
FIG. 8 is an image of the rolled tissue product produced as set forth in Example 1.
Figure 9:
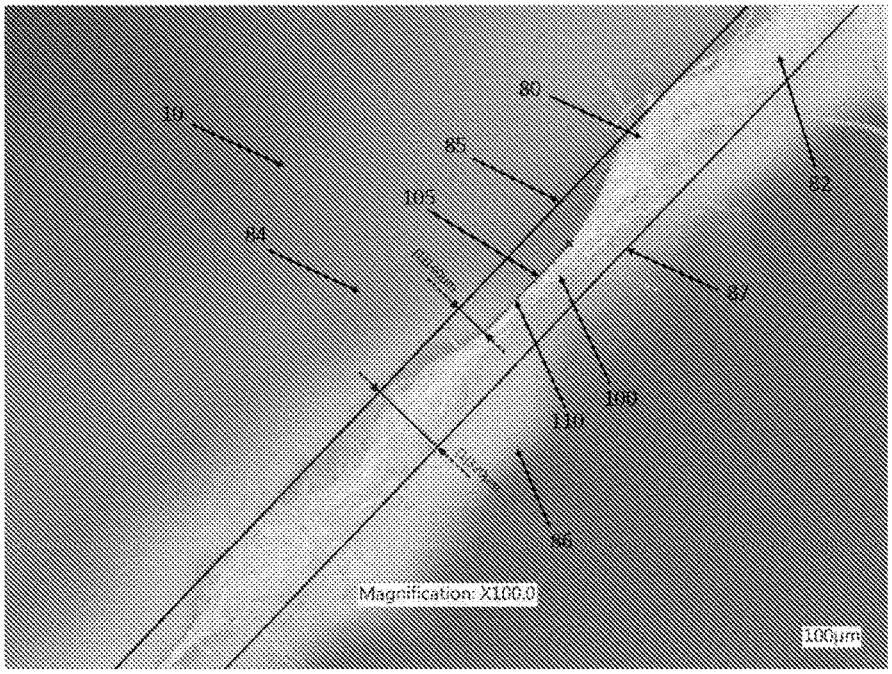
FIG. 9 is a cross-sectional image of the tissue product produced as set forth in Example 1 illustrating the surface plane, design element plane and the bottom plane, the image has taken using a VHX-1000 Digital Microscope manufactured by Keyence Corporation of Osaka, Japan at a magnification of ×100.

The calendered basesheet was then converted by subtractive texturing substantially as illustrated in FIG. 7. An applicator roll applied water to the web at a nip between the applicator roll and the patterned roll. In this manner water was selectively applied to the web in registration with the design element. The estimated water add-on was about 2 percent, by weight of the web. The subtractive texturing imparted a design pattern to the tissue product, which is illustrated in FIGS. 8 and 9. Details of the subtractive texturing are set forth in Table 1, below. The first receiving roll was a rubber backed roll having a 65 shore A rubber backing. The second receiving roll was a smooth steel roll. The finished product was subjected to physical testing and the results are summarized in Table 2, below.

TABLE 1

| Pattern | Protuberance Height (mm) | Pattern Roll to Second Receiving Roll Loading Pressure (psi) | First Nip Width (mm) |
|---|---|---|---|
| Discrete Line Element | 1.4 | 75 | 20 |

TABLE 2

| Sample | BW (gsm) | Caliper (μm) | GMT (g/3") | GM Stretch (%) | GM Slope (kg) | Stiffness Index |
|---|---|---|---|---|---|---|
| Basesheet | 44.9 | 1113 | 1052 | 16.4 | 7.71 | 7.3 |
| Product | 42.3 | 444 | 898 | 6.86 | 6.47 | 7.2 |

A perspective image of the finished product is shown in FIG. 8, which illustrates a tissue product 10 having a plurality of continuous elevated line elements 80 and a plurality of valleys 82 there-between. The tissue product 10 further comprises a design element 100, which was imparted by subtractive texturing as described above.

A cross-section of the resulting tissue product is shown in FIG. 9. The cross-section image was taken using a VHX-1000 Digital Microscope manufactured by Keyence Corporation of Osaka, Japan. The microscope was equipped with VHX-H3M application software, also provided by Keyence Corporation. Using the Keyence software a first line has been drawn approximately along the top surface plane of the tissue product with the line tangent to two adjacent elevated line elements. A second line has been drawn approximately along the bottom surface plane of the tissue product with the line tangent to two adjacent valleys. A third line has been drawn approximately along the top surface plane of the design element with the line tangent to the top surface of the design element. With the three lines drawn, each corresponding to a surface plane of the tissue product, the digital microscope software can be instructed to calculate the distances between the planes, as is shown in FIG. 9.

With reference to FIG. 9, generally the elevated line elements 80 are coextensive with the upper surface plane 85 and define the upper surface 84 of the tissue product 10. Opposite the upper surface 84 is the bottom surface 86 of the tissue product 10. The bottom surface 86 is generally defined by the bottom surface plane 87 which is coextensive with the valleys 82 lying between the elevated line elements 80. The product 10 further comprises a design element 100. The design element 100 has an upper surface 105 lying in a design element plane 110, which is generally between the upper surface plane 85 and the bottom surface plane 87. In the present example, the distance between the upper surface plane 85 and the bottom surface plane 87 is about 320 μm, the distance between the upper surface plane 85 and the design element plane 110 is about 140 μm.

Example 2

A single ply tissue product was produced using a through-air dried papermaking process substantially as described above with the exception that the through-air drying fabric was fabric described previously in U.S. Pat. No. 8,752,751 as T2407-13. Transfer to the through-drying fabric was done using vacuum levels of greater than 10 inches of mercury at the transfer. The web was then dried to approximately 98 percent solids before winding.

The basesheet was calendered using a conventional polyurethane/steel calender system comprising a 40 P&J polyurethane roll on the air side of the sheet and a standard steel roll on the fabric side at a loading of 40 pli.

The calendered basesheet was then converted by subtractive texturing substantially as illustrated in FIG. 7. The subtractive texturing imparted a design pattern to the tissue product. Details of the subtractive texturing are set forth in Table 3, below. The first receiving roll was a rubber backed roll having a 65 shore A rubber backing. The second receiving roll was a smooth steel roll. The finished product was subjected to physical testing and the results are summarized in Table 4, below.

TABLE 3

| Pattern | Protuberance Height (mm) | Pattern Roll to Second Receiving Roll Loading Pressure (psi) | First Nip Width (mm) |
|---|---|---|---|
| Discrete Line Element | 1.4 | 75 | 27 |

TABLE 4

| BW (gsm) | Caliper (μm) | GMT (g/3") | GM Stretch (%) | GM Slope (kg) | Stiffness Index | Background Smoothness (MIU) | Design Element Smoothness (MIU) |
|---|---|---|---|---|---|---|---|
| 58.9 | 785 | 3248 | 17.8 | 9.49 | 2.92 | 0.31 | 0.20 |

A cross-section image of the finished product was taken using a VHX-1000 Digital Microscope manufactured by Keyence Corporation of Osaka, Japan. The microscope was equipped with VHX-H3M application software, also provided by Keyence Corporation. Using the Keyence software a first line has been drawn approximately along the top surface plane of the tissue product with the line tangent to two adjacent elevated line elements. A second line has been drawn approximately along the bottom surface plane of the tissue product with the line tangent to two adjacent valleys. A third line has been drawn approximately along the top surface plane of the design element with the line tangent to the top surface of the design element. The distance between the upper surface plane and the bottom surface plane was about 372 μm, the distance between the upper surface plane and the design element plane was about 193 μm.

We claim:

1. A method of manufacturing a patterned tissue product comprising the steps of:

a. providing a tissue web having a textured top surface lying in a surface plane and a bottom surface lying in a bottom plane wherein there is a z-directional height difference between the surface plane and the bottom plane;

b. conveying the web through a first nip created by a first receiving roll and a pattern roll having a plurality of protuberances forming a design pattern;

c. conforming a portion of the web to the protuberances;

d. applying a chemical papermaking additive selected from the group consisting of strength agents, bonding agents, softening agents, lotions, humectants, emollients, vitamins and colorants to an applicator roll;

e. conveying the web through a second nip created by the pattern roll and the applicator roll;

f. applying the additive to the conformed portion of the web; and g. conveying the web into a third nip formed between the pattern roll and a second receiving roll, wherein the pressure applied at the third nip is from about 100 to about 250 pli and the second receiving roll has a hardness from about 40 to about 100 Shore (A), to form a patterned tissue product having a design element corresponding to the plurality of protuberances, the design element lying in a design element plane that is between the surface plane and the bottom plane.

2. The method of claim 1 wherein the additive composition is water and the add-on is less than about 2 percent, based upon the dry weight of the web.

3. The method of claim 1 wherein the additive composition is water and the add-on area is less than about 10 percent of the surface area of the web.

4. The method of claim 1 wherein the textured tissue web comprises a wet laid tissue web having a moisture content less than about 10 percent, by weight of the web.

5. The method of claim 1 further comprising the step of calendering the textured tissue web wherein the calendered textured tissue web has a caliper from about 300 to about 1,000 μm.

6. The method of claim 5 wherein the caliper of the patterned tissue product is from about 300 to about 1,000 μm.

7. The method of claim 1 wherein the textured tissue web has a sheet bulk from about 5 to about 20 cc/g and the sheet bulk of the patterned tissue product is from about 2 to about 10 percent less than the sheet bulk of the textured tissue web.

8. The method of claim 1 wherein the z-directional height difference between the surface and bottom planes is greater than about 300 μm.

9. The method of claim 1 wherein the z-directional height difference between the surface and design element planes is at least about 100 μm.

10. A method of manufacturing a patterned tissue product comprising the steps of:

a. providing a tissue web having a textured top surface lying in a surface plane and a bottom surface lying in a bottom plane wherein there is a z-directional height difference between the surface plane and the bottom plane;

b. conveying the web through a first nip created by a first receiving roll and a pattern roll having a plurality of protuberances forming a design pattern;

c. conforming a portion of the web to the protuberances whereby a portion of the web is registered with the protuberances;

d. applying from about 2 to about 3 percent, by weight of the web, steam to wet the portion of the web in registration with the protuberances; and e. maintaining registration between the web and the protuberances while conveying the web through a second nip formed between the pattern roll and a second receiving roll to form a patterned tissue product having a design element corresponding to the plurality of protuberances, the design element lying in a design element plane that is between the surface plane and the bottom plane.

11. The method of claim 10 further comprising the steps of applying a chemical papermaking additive selected from the group consisting of strength agents, bonding agents, softening agents, lotions, humectants, emollients, vitamins and colorants to an applicator roll; conveying the web through a third nip created by the pattern roll and the applicator roll; applying the additive to the conformed portion of the web.

* * * * *